US008752463B2

(12) United States Patent
Buerge

(10) Patent No.: US 8,752,463 B2
(45) Date of Patent: Jun. 17, 2014

(54) DEVICE FOR TRIMMING THE TOP AND/OR BOTTOM EDGE OF PRINTED PRODUCTS MOVED THROUGH A CUTTING TOOL

(75) Inventor: Marcel Buerge, Niedergoesgen SO (CH)

(73) Assignee: Mueller Martini Holding AG, Hergiswil (CH)

( * ) Notice: Subject to any disclaimer, the term of this patent is extended or adjusted under 35 U.S.C. 154(b) by 672 days.

(21) Appl. No.: 12/479,116

(22) Filed: Jun. 5, 2009

(65) Prior Publication Data

US 2009/0301279 A1 Dec. 10, 2009

(30) Foreign Application Priority Data

Jun. 5, 2008 (EP) ..... 08157677

(51) Int. Cl.

| | |
|---|---|
| ***B26D 5/00*** | (2006.01) |
| ***B27B 25/02*** | (2006.01) |
| ***B27B 5/00*** | (2006.01) |
| ***B26D 1/00*** | (2006.01) |
| ***B42B 2/00*** | (2006.01) |
| ***B65H 39/00*** | (2006.01) |
| ***B65H 39/02*** | (2006.01) |
| ***B65H 41/00*** | (2006.01) |

(52) U.S. Cl.
USPC ..... 83/651; 83/404.4; 270/52.17

(58) Field of Classification Search
USPC ..... 83/651, 657, 401, 404, 404.4, 404.2, 83/703–708, 409, 732, 206, 277, 409.1, 83/341, 934, 636, 327; 270/52.17
See application file for complete search history.

(56) References Cited

U.S. PATENT DOCUMENTS

| | | | | |
|---|---|---|---|---|
| 2,208,350 | A * | 7/1940 | Ungar | 83/299 |
| 3,074,304 | A | 1/1963 | Coie | |
| 3,122,041 | A * | 2/1964 | Kile et al. | 83/155 |
| 3,884,102 | A * | 5/1975 | Faltin | 83/155 |
| RE28,840 | E * | 6/1976 | Sarring | 83/63 |
| 4,341,135 | A * | 7/1982 | Ufermann et al. | 83/23 |
| 4,796,499 | A * | 1/1989 | Achelpohl | 83/151 |
| 4,922,773 | A * | 5/1990 | Ito | 83/76.6 |

(Continued)

FOREIGN PATENT DOCUMENTS

| | | |
|---|---|---|
| CH | 565 632 | 8/1975 |
| DE | 103 25 378 | 2/2004 |

(Continued)

OTHER PUBLICATIONS

European Search Report dated Nov. 17, 2008 issued in Priority Application No. 08157677.9.

*Primary Examiner* — Ghassem Alie
*Assistant Examiner* — Bharat C Patel
(74) *Attorney, Agent, or Firm* — Venable LLP; Robert Kinberg; F. Brock Riggs

(57) ABSTRACT

A device for cutting printed products arranged successively spaced apart and transverse to a conveying direction. The device includes a conveyor to convey the print products in the conveying direction. The printed products rest on a flat side on the conveyor and convey with a bound edge forward. The device also includes a cutting tool synchronized with a timing of the conveyor so that the cutting tool cuts a top and/or bottom edge of the printed products. The device also including a cutter upstream of the cutting tool in the conveying direction so that the cutter is synchronized with the cutting tool and operative to make a cut to the bound edge.

14 Claims, 2 Drawing Sheets

(56) References Cited

U.S. PATENT DOCUMENTS

| | | | | |
|---|---|---|---|---|
| 4,932,301 | A * | 6/1990 | Buck | 83/640 |
| 6,152,002 | A * | 11/2000 | Muller | 83/37 |
| 6,193,458 | B1 * | 2/2001 | Marsh | 412/1 |
| 6,536,319 | B1 * | 3/2003 | Boss | 83/247 |
| 6,796,209 | B2 * | 9/2004 | Boss | 83/365 |
| 6,895,847 | B2 * | 5/2005 | Muller | 83/618 |
| 7,014,182 | B2 * | 3/2006 | Marsh | 270/58.07 |
| 7,493,840 | B2 * | 2/2009 | Yamaguchi et al. | 83/276 |
| 7,503,555 | B2 * | 3/2009 | Dobrovolsky | 270/58.07 |
| 2003/0145703 | A1 * | 8/2003 | Rohe-Krebeck | 83/277 |
| 2004/0020340 | A1 * | 2/2004 | Burke et al. | 83/613 |
| 2004/0134893 | A1 * | 7/2004 | Duquette | 219/121.67 |
| 2005/0016345 | A1 * | 1/2005 | Lorenzi | 83/151 |
| 2005/0066781 | A1 * | 3/2005 | Begemann | 83/13 |
| 2005/0269694 | A1 * | 12/2005 | Luechinger | 257/724 |
| 2007/0209492 | A1 * | 9/2007 | Schmid | 83/33 |
| 2009/0000440 | A1 * | 1/2009 | Graushar et al. | 83/52 |

FOREIGN PATENT DOCUMENTS

| | | | |
|---|---|---|---|
| DE | 103 57 815 | A1 | 7/2004 |
| EP | 0 698 451 | A | 2/1996 |
| EP | 1 410 925 | | 4/2004 |
| EP | 103 57 815 | | 7/2004 |

* cited by examiner

DEVICE FOR TRIMMING THE TOP AND/OR BOTTOM EDGE OF PRINTED PRODUCTS MOVED THROUGH A CUTTING TOOL

CROSS-REFERENCE TO RELATED APPLICATION

This application claims priority to European Patent Application No.: 08157677.9, filed on Jun. 5, 2008, the subject matter of which is incorporated herein by reference.

BACKGROUND OF THE INVENTION

The invention relates to a device for trimming or cutting the top edges and/or the bottom edges of printed products. The printed products are arranged successively and spaced apart. The printed products rest on a flat side transverse to the conveying direction, preferably with the bound edge of the printed products conveyed forward. The printed products may be held by a conveying device of a conveyor. The printed products may be moved through a cutting tool that operates synchronized with the timing of the conveying device.

Devices of the aforementioned type may be used for cutting or trimming perfect-bound or wire-stitched printed products along three sides. Examples of such products include, but are not limited to, booklets, magazines, catalogs, paperback books, and/or other similar printed products. The cutting or trimming of the edges may represent a final operation to be carried out on the individual printed products, apart from inserting supplements, affixing addresses, stacking the products, or other similar tasks involving the finishing of the printed products. The appearance of the finished printed products may be significantly influenced by the quality of the trimming.

As a result of the characteristics of printed products, various configurations are known for the cutting tools or trimmers. These trimmers are also referred to as three-way cutters or automatic three-knife trimmers. A joint feature of known cutting devices may include conveying the printed products individually or in stacks in a serial flow through cutting devices, normally at a high clocking rate, and processing the printed products or trimming the printed products therein.

During the cutting or trimming, the printed products may be held while clamped and/or pressed between two essentially parallel bars, at least in the area directly adjacent to the cutting location. Cutting knives typically move in one plane and the blades typically form an acute angle with the flat sides of the printed products, at least at the start of the cutting operation. Such configuration may aid in the initial cut.

The cutting movement of the knives may be perpendicular to the flat sides of the printed products. However, superimposing a speed component parallel to the flat sides is also known, which results in a drawn-out cut. Counter knives or cutting bars for absorbing the cutting forces may be arranged on the sides of the printed products that are opposite the sides facing the knives. The top and bottom cuts may be generally made at the same time while the trimming of the front may be realized with a time offset, meaning the front trimming occurs either before or after the trimming of the top and bottom.

European patent document EP 0 698 451 B1, for example, discloses a device of the aforementioned type. The printed products are conveyed with a constant speed and with the aid of grippers, attached uniformly spaced apart to a circulating traction device. The printed products are conveyed through the cutting device and are trimmed during the conveying operation with the aid of cutting or trimming units, which in part also move along.

Also known are devices in which the printed products are cyclically accelerated and delayed. These devices trim printed products by locally fixed trimming units while the printed products are stopped. The cutting edges of the knives extend nearly parallel to the flat sides of the printed products while the knives move perpendicular to the flat sides. However, considerable stresses can occur in the printed products during the trimming operation. Such stresses can be high enough to damage and/or tear the covers on the back, in the areas adjacent to the trimming.

Swiss patent document CH 565 632 proposes that a specific portion of the cutting edge of the side knives, which is used for cutting the back of the booklet during the top and bottom trimming, encloses an angle of between 60° and 90° with the plane upon which the booklet rests. The embodiment shown in FIG. 1 of the Swiss patent document shows that damage to the back area of the cover can be avoided. However, a disadvantage of this device is that uneven cutting surfaces may result due to the simultaneous cutting from two outer regions of the printed products. With the embodiment according to FIG. 3 of the Swiss document, the angle $\alpha'$ must be nearly 90° because one component of the cutting force is directed away from the back. Therefore, a large knife stroke is required perpendicular to the resting surface and/or the flat side of the printed product.

German patent document DE 103 25 378 A1 proposes that the trimming knife has a knife edge composed of a first section and a second section. The second section is positioned at an angle relative to the first section. A disadvantage of this device, however, is that a larger knife stroke is required perpendicular to the flat sides of the printed products.

According to the method proposed in European patent document EP 1 410 925 A2, the printed products are configured so that the book back encloses an acute angle with the resting surface and that one component of the cutting forces is directed toward the back. However, a disadvantage of this method is that the strong deformation of the printed products may result in excessive stress to the binding and/or that the back of the printed product may experience a permanent deformation.

The German patent document DE 103 57 815 A1 proposes a pre-scoring of the cutting region on the back of the printed product, using a laser beam. A disadvantage of this method is that the burning of the cover surface causes dangerous smoke to develop, which may endanger health and must be suctioned off. In addition, a system with the capacity required for realizing this method is extremely involved, expensive, and difficult to regulate. Measures must also be taken to prevent danger to the personnel caused by the laser, as well as precautions to prevent fire.

SUMMARY

An embodiment of the present invention may reduce the stress in the back region of the printed products caused by cutting forces during the top and bottom trimming. The reduction in stress may eliminate damage to covers. At the same time, embodiments of the invention may avoid the disadvantages of known devices as previously discussed.

The above and other objects are accomplished according to one aspect of the invention, wherein there is provided a device for cutting printed products arranged successively spaced apart and transverse to a conveying direction, comprising: a conveyor to convey the print products in the conveying direction, wherein the print products rest on a flat side on the conveyor and convey with a bound edge forward; a cutting tool synchronized with a timing of the conveyor, wherein the cutting tool cuts a top and/or bottom edge of the printed products; and a cutter upstream of the cutting tool in the conveying direction, the cutter being synchronized with the cutting tool and operative to make a cut to the bound edge.

BRIEF DESCRIPTION OF THE DRAWINGS

The present invention will be more readily understood from the following detailed description when read in conjunction with the accompanying drawings, in which.

DETAILED DESCRIPTION

Figure 1:
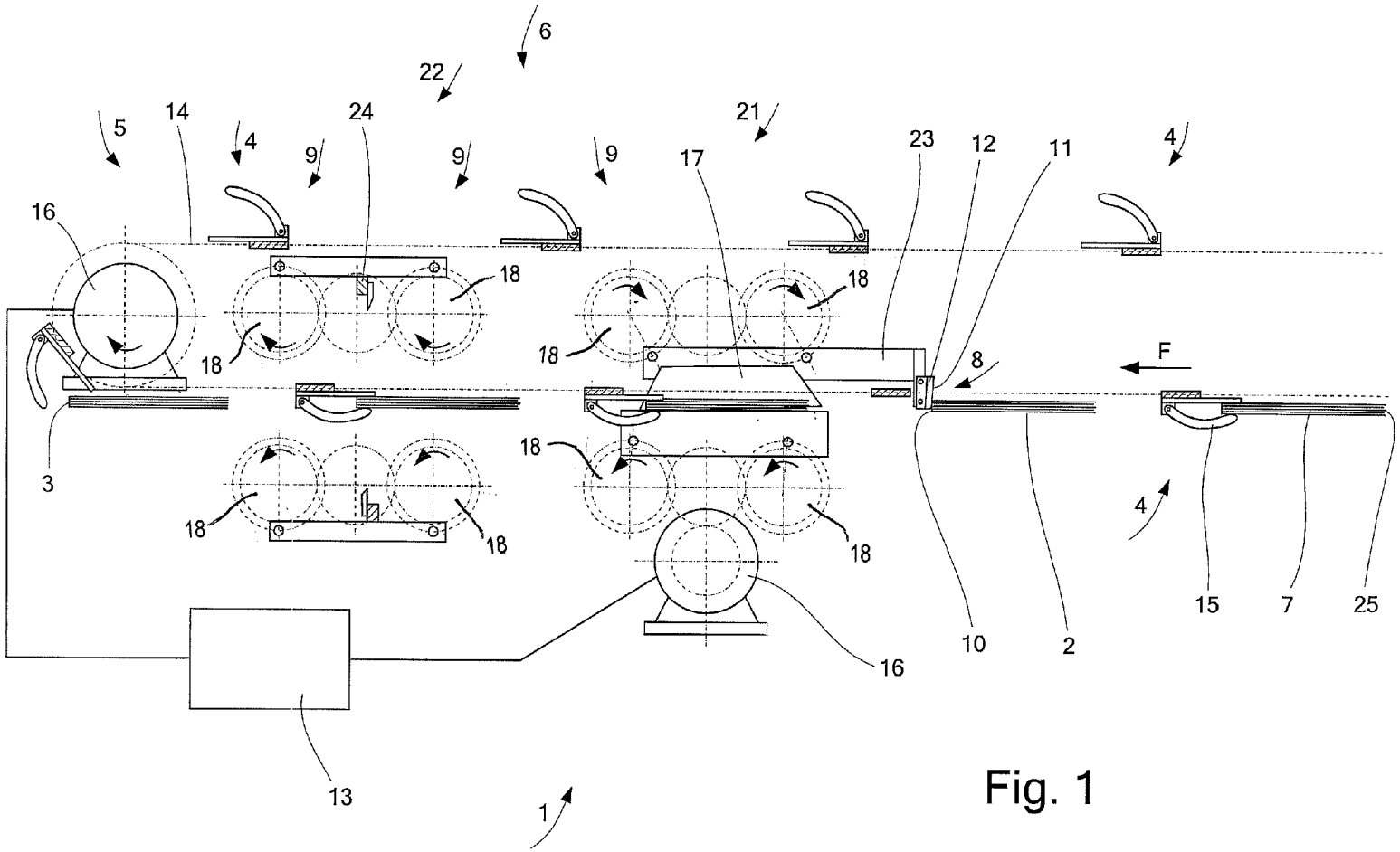
FIG. 1 is a schematic view from the side of a cutting device including a cutting tool according to an embodiment of the invention.

The cutter 8 is installed upstream of the cutting tool 6, is synchronized with the cutting tool and cuts perpendicular to the bound edge 3. The cutter comprises a cutting knife 12 with a cutting edge 11 that extends perpendicular to the book back 10. According to one preferred embodiment, the cutter 8 is arranged on a knife support 23 that is connected to a knife 17 of the top/bottom cutting unit 21. As a result of this device, the cover at the book back 10 is precut, approximately synchronized with the top/bottom trimming, but earlier by at least one conveying cycle. In FIG. 1, the gripper for the printed product shown being precut by cutter 8 is omitted for clarity. The advantage of this device is that when adjusting the back length through displacement of the knife 17 transverse to the conveying direction F, the cutter 8 is automatically also adjusted. If the front cutting unit 22 is arranged upstream of the top/bottom cutting unit 21, the cutter 8 can alternatively also be connected to the knife carrier 24 for the front cutting unit 22. However, because of the requirement to adjust to different formats, the cutter 8 in that case must be embodied such that it can be adjusted transverse to the conveying direction F, relative to the front trimming knife.

Figure 2:
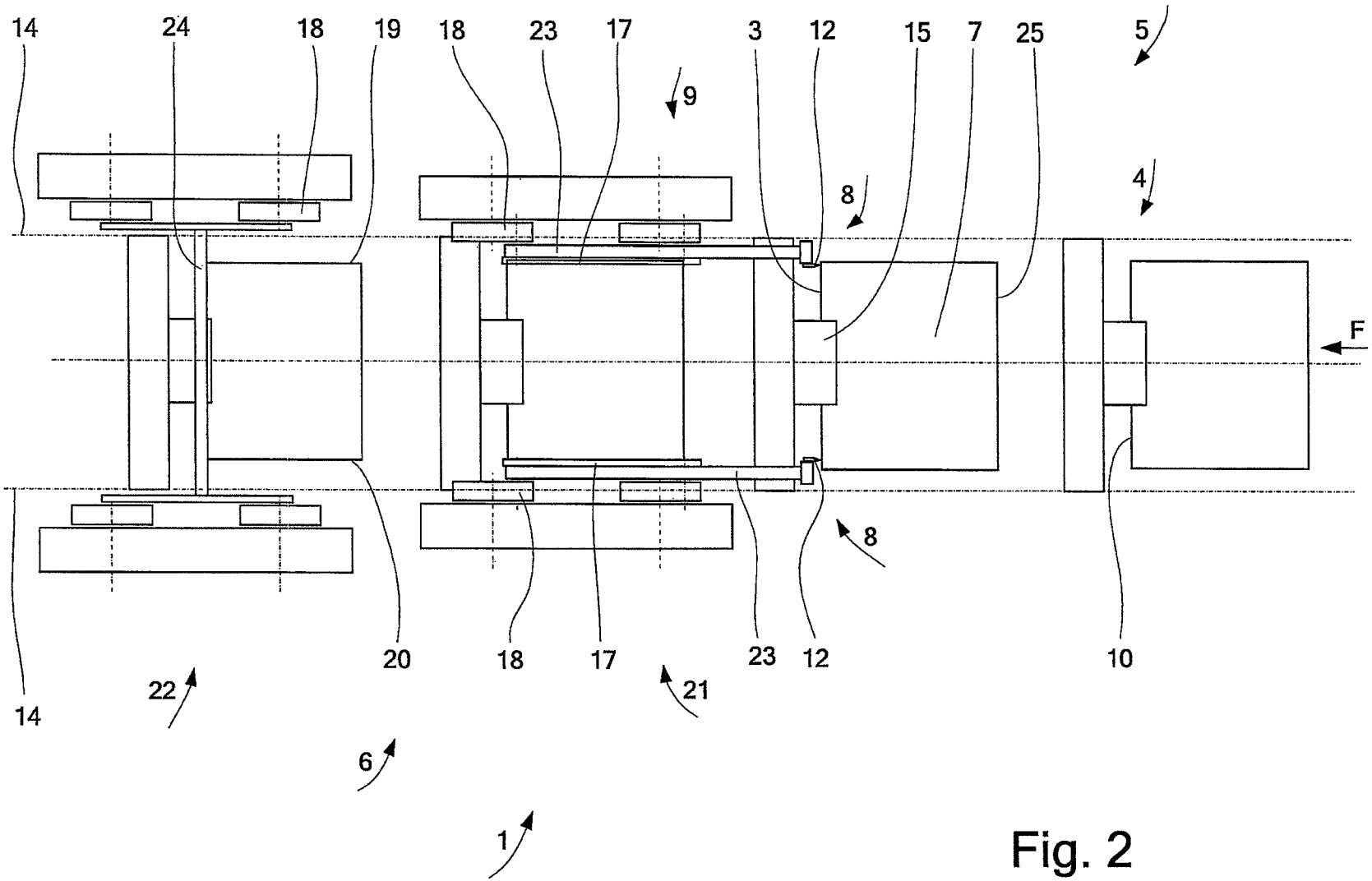
FIG. 2 is a view from above of the cutting device as shown in FIG. 1.

The cutting tool 6 may essentially comprise a cutting unit 21 for the top/bottom trimming, a cutting unit 22 for the front trimming, and a cutter 8. With the embodiment of the cutting tool 6 shown in the figures, the top/bottom cutting unit 21 is arranged upstream of the front cutting unit 22. However, embodiments of the invention are not restricted to cutting devices 1 using the aforementioned sequence of cutting steps, but also includes cutting devices 1 using a reverse sequence of cutting steps. As shown in FIGS. 1 and 2, the cutting tool 6 is embodied as a crank-operated cutting tool. The ends of the cutting knives on the cutting units 21 and 22, move along circular paths. Each cutting knife is driven by a crank mechanism 9. The crank mechanism may have identical radii, but the mechanism may also have different radii. All cranks 18 may be operatively drive-connected via gears, not shown herein. Therefore, the cranks 18 may be driven angle-synchronous. According to one embodiment, the cutting tool 6 and/or the conveyor 5 are driven with the aid of rotational-angle controlled electric motors 16, which are coupled to a control unit 13.

The distance between the cutting edge 11 and the book back 10 and also the depth of the cut made by the cutting knife 12 in the book back 10, may be adjusted with the aid of the control unit 13. The control unit 13 connects the cutting tool 6 with the conveyor 5. For example, if the position of the conveyor 5 in conveying direction F is adjusted by a certain amount via the control unit 13, the cutting depth of the cutting knife correspondingly increases by the same amount.

The cutting depth may also be changed by changing the timing of the cutting tool 6 relative to the conveyor 5. For example, if the contact between the cutting edge 11 and the book back 10 occurs at an earlier time, then the cutting depth will decrease. To adjust the cut book width, the drive for the front cutting unit 22 may be adjustable, relative to the drive for the conveyor 5. Alternatively, the front cutting unit 22 may also be driven with the aid of a separate rotational-angle controlled electric motor, not shown herein, which is connected to the control unit 13. In that case, the timing adjustment for the front cutting unit 22, relative to the conveyor 5, or the adjustment of the book width, may be achieved directly by adjusting the synchronization of the electric drives.

The cutter 8 may be installed upstream of the cutting tool 6 and may be synchronized with the cutting tool. The cutter 8 may cut perpendicular to the bound edge 3. The cutter 8 comprises a cutting knife 12 with a cutting edge 11 that extends perpendicular to the book back 10. According to one embodiment of the invention, the cutter 8 may be arranged on a knife support 23 that is connected to a knife 17 of the top/bottom cutting unit 21. As a result of this configuration, the cover at the book back 10 may be precut. The cut may be approximately synchronized with the top/bottom trimming, but earlier by at least one conveying cycle.

An advantage of such configuration may be that when adjusting the back length through displacement of the knife 17 transverse to the conveying direction F, the cutter 8 may be automatically adjusted. If the front cutting unit 22 is arranged upstream of the top/bottom cutting unit 21, the cutter 8 may alternatively be connected to the knife carrier 24 for the front cutting unit 22. However, because of the requirement to adjust to different formats, the cutter 8 in such case may be embodied to adjust transverse to the conveying direction F, relative to the front trimming knife.

For the embodiment shown according to the figures, the cutting tool 6 is embodied as a scissor-type cutting tool 6. However, embodiments of the invention are not limited to cutting devices 1 operating based on this principle. Embodiments also include cutting tools 6 that have knives 10 that cut against cutting bars. Cutting tools 6 that include knives 17 to carry out a superimposed movement parallel to the flat sides 2 (a swing cut) may be used in addition to the movement perpendicular to the flat sides 2.

An embodiment of the invention furthermore includes cutting devices for which the cutting and trimming operation is realized either during the conveying of the printed products 7 or while the printed products 7 are stopped.

It will be understood that the above description of the present invention is susceptible to various modifications, changes and adaptations, and that the same are intended to be comprehended within the meaning and range of equivalents of the appended claims.

What is claimed is:

1. A device for cutting printed products arranged successively spaced apart and transverse to a conveying direction, comprising:

a conveyor to convey the printed products in the conveying direction, wherein the printed products are conveyed with a bound edge forward in the conveying direction;

a cutting tool synchronized with a timing of the conveyor, wherein the cutting tool comprises:

a first cutting unit configured to cut at least one of a top edge and a bottom edge of the printed products, and a second cutting unit configured to cut a front edge of the printed products, the front edge being opposite to the bound edge;

a cutter upstream of the first cutting unit in the conveying direction, the cutter comprising a cutter knife with a cutting edge that extends perpendicular to the bound edge and pointing against the conveying direction of the printed products; and a control unit that controls the cutter to be synchronized with at least one of the first and second cutting units of the cutting tool and to make a precut perpendicular to the bound edge.

2. The device according to claim 1, wherein the cutting tool executes a scissor cut when cutting at least one of the top edge, the bottom edge, and the front edge of the printed products.

3. The device according to claim 2, wherein the control unit controls the conveyor to stop conveying printed products during a cutting operation.

4. The device according to claim 2, wherein the control unit controls the conveyor to convey the printed products during a cutting operation.

5. The device according to claim 1, wherein the control unit controls the conveyor to stop conveying the printed products during a cutting operation.

6. The device according to claim 1, wherein the control unit controls the conveyor to convey the printed products during a cutting operation.

7. The device according to claim 1, wherein the control unit connects the cutting tool with the conveyor, the control unit adjusts a distance between the cutting edge and the bound edge, and the control unit adjusts a depth of the precut made by the cutter knife.

8. The device according to claim 7, further comprising a rotational-angle controlled electric motor coupled to the control unit, wherein the motor drives the cutting tool and the conveyor.

9. The device according to claim 7, further comprising a first and a second rotational-angle controlled electric motor coupled to the control unit, wherein the first motor drives the cutting tool and the second motor drives the conveyor.

10. The device according to claim 1, further comprising a circulating traction device, wherein the conveyor further comprises spaced-apart grippers attached to the circulating traction device, wherein the grippers grip and hold the printed products in a region of the bound edge.

11. The device according to claim 1, further comprising a crank mechanism, wherein the crank mechanism operates the cutter knife.

12. The device according to claim 1, wherein the first cutting unit is located upstream of the second cutting unit.

13. The device according to claim 1, wherein the cutter is coupled to the first cutting unit.

14. The device according to claim 1, wherein the first cutting unit is configured to cut at least one of the top edge and the bottom edge of the printed products along a plane that includes the precut.

* * * * *